US005464002A

United States Patent [19]

Lavoie et al.

[11] Patent Number: 5,464,002

[45] Date of Patent: Nov. 7, 1995

[54] ARCHERY ARMGUARD DEVICE

[76] Inventors: Camilien Lavoie, 582 Chemin des Voyageurs; Pierre Hervieux, 561 du Progrés, both of St-Philippe, Canada

[21] Appl. No.: 298,166

[22] Filed: Aug. 30, 1994

[51] Int. Cl.[6] ..... F41B 5/14

[52] U.S. Cl. ..... 124/86; 124/23.1

[58] Field of Search ..... 124/23.1, 24.1, 124/25.6, 86, 88, 89

[56] References Cited

U.S. PATENT DOCUMENTS

| | | | |
|---|---|---|---|
| 4,343,286 | 8/1982 | Thacker | 124/88 X |
| 4,377,152 | 3/1983 | Saunders | 124/88 |
| 4,787,361 | 11/1988 | Vyprachticky | 124/88 |
| 5,103,798 | 4/1992 | McGraw et al. | 124/88 |
| 5,137,008 | 8/1992 | Taylor | 124/88 |
| 5,349,937 | 9/1994 | Burling | 124/25.6 |

*Primary Examiner*—John A. Ricci

*Attorney, Agent, or Firm*—Pierre Lespérance; François Martineau

[57] ABSTRACT

An armguard device for use with an archer's compound bow, the compound bow of the type including an arcuate frame tensioning a bowstring and from which transversely projects an elongated, elbowed stabilizer shaft. The armguard device consists of: a slider member, slidingly engageable with the stabilizer shaft for lengthwise displacement therealong; a rigid shield, for engaging the archer's forearm and for shielding same against bowstring release whiplash; and set screws, for releasably anchoring the shield member to the slider member, whereby a laterally offset positioning of the shield member is achieved relative to the stabilizer shaft, to slightly offset the shield member from the bowstring pathway to allow unhindered release thereof; wherein the distance between the shield member and the bow frame is adjustable by displacing the slider member along the stabilizer shaft, to fit the arms of archers of different heights.

10 Claims, 2 Drawing Sheets

ARCHERY ARMGUARD DEVICE

FIELD OF THE INVENTION

This invention relates to armguards used by archers to protect their forearm from the whiplash shearing force that follows release of the drawn bowstring.

BACKGROUND OF THE INVENTION

Due to the increasing pressure of gun-control activists, in view of reports of ever increasing violence against humans, especially in the streets of America, there are increasing restrictions to the market sale, distribution or use of shotguns, rifles, revolvers, and the like weapons. Since weapons that are lethal for humans are usually lethal against animals, these increasing regulatory impediments also affect the field of game hunting. Fortunately, archery remains for the time being substantially unaffected by such heavy bureaucratic hassle, when comes the time to purchase such a weapon or to operate this weapon in the field. The fact that the effective range of archery bows, even with the high performance compound bows, is limited to less than 40 meters, may not be foreign to this situation.

Upon shooting any type of archery bow, the central stretch of the bowstring, as drawn to a full draw position, may, upon release of the bowstring to drive the arrow towards the target, shear in a whiplash-like effect the archer's forearm, and thus strike and chafe the same. Moreover, with the advent of high-performance bows, particularly the so-called "compound bow", the draw weight or string force of the bow has become substantially higher, wherein such bowstring contact with the forearm does represent a potential for significant bodily harm to the archer. Such an action may also cause the archer's arm to flinch or otherwise move, thus further thrusting the bow and diverting the arrow from the target.

To counteract such problems, sheet armguards have first been developed in the art. Such sheet armguards, which are often made from leather or leather-like resistant materials, are attached in particular to the interior face of the forearm. With such a sheet armguard, the string whiplash shearing action is borne solely by the free external surface of the sheet armguard.

The disadvantages of these sheet armguards are many. First, this sheet is not easy to properly secure to the forearm: if it is too tightly secured, blood circulation is hampered and the arm grows numb; and if it is too lightly secured, it tends to slide off from its operative position. Moreover, when the released bowstring strikes this sheet armguard, the arrow will be diverted from its original aim.

This is why there has been developed armguards that were integrally mounted to the bow frame. The attention of the reader is drawn in particular to the following two recent U.S. patents: U.S. Pat. No. 5,103,798 issued Apr. 14, 1992 to Michael MCGRAW and Aaron BAKER; and U.S. Pat. No. 5,137,008 issued Aug. 11, 1992 to Anthony TAYLOR. The problem with these armguards is that they are generally crude in design. In particular, the McGraw patent requires that a block member be anchored to the bow frame by bolt members, thus compromising the structural integrity of the expensive bow; moreover, the arm guard is simply a transverse substantially straight rod, which means that the forearm is not fully shielded since any accidental lateral offsetting of the releasing bowstring will be able to shear the forearm skin even in the presence of this arm guard rod.

The Taylor patent is an improvement in this regard, since it includes an armguard with a rectangular plate that is pivoted to a hinge bracket, the hinge bracket being in turn anchored to the bow frame. The rectangular plate is upwardly inclined, and defines therefore an extended planar surface that decreases the likelihood of accidental skin chafing due to the releasing bowstring. However, the straight shape of the Taylor armguard main embodiment makes it possible for the bowstring to get caught between the armguard and the archer arm. Also, the bowstring will probably wear out due to the friction between it and the armgard edges that are thin (and thus sharper) and are especially dangerous for the bowstring when the armguard is inclined (as illustrated in FIGS. 1, 4, 5, 6, 8 and 10) because the contact will then most likely occur between the bowstring and the edges. FIG. 9 shows another embodiment of the invention without an upwardly inclined armguard, but it is likely that the bowstring will slightly bend around the outwardly angled section 404 and wear out due to section 404 edges.

OBJECTS OF THE INVENTION

The main object of this invention is to provide an armguard that will effectively shield the forearm against bodily injury from bowstring backlash, while not compromising the travel path of the released arrow.

An important object of the invention is to provide transverse adjustment of the armguard relative to the bow frame, slidingly along the stabilizer rod of the bow, to fit archer arms of varying lengths.

Another object of the invention is to improve wear comfort of the armguard and confidence of the archer.

An object of the invention is to eliminate the requirement of donning and undonning the armguard each time the bow is to be used, since the armguard forms an integral part of the bow.

A further object is to facilitate bowstring stretching, since the bow bearing arm will not move nor shake under the bowstring draw effort.

An important object of the invention is that the armguard of the invention, to be connected to the bow, does not necessitate any modification of the bow frame.

SUMMARY OF THE INVENTION

Accordingly with the objects of the invention, there is disclosed an armguard device for use with an archer's compound bow, the compound bow of the type including an arcuate frame tensioning a bowstring and from which transversely projects an elongated, elbowed stabilizer shaft, said armguard device consisting of:

(a) a slider member, slidingly engageable with said stabilizer shaft for lengthwise displacement therealong;

(b) a rigid shield member, for engaging the archer's forearm and for shielding same against bowstring release whiplash; and (c) anchoring means, for releasably anchoring said shield member to said slider member, whereby a laterally offset positioning of the shield member is achieved relative to the stabilizer shaft, to slightly offset the shield member from the bowstring pathway to allow unhindered release thereof; wherein the distance between said shield member and said bow frame is adjustable by displacing said slider member along said stabilizer shaft, to fit the arms of archers of different heights.

DETAILED DESCRIPTION OF THE DRAWINGS

Figure 1:
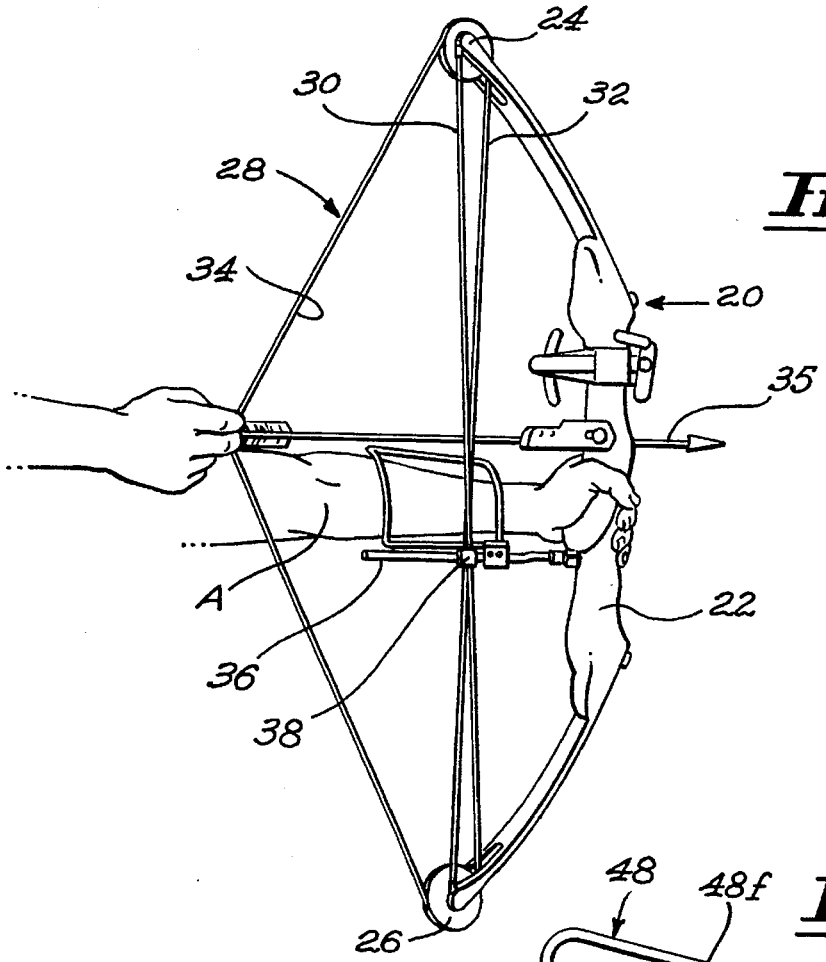
FIG. 1 is a side elevational view of a compound bow with the bowstring being extended by the hand of an archer and with an arrow being properly positioned thereon, and including a first and preferred embodiment of the integral armguard device of the invention.
Figure 2:
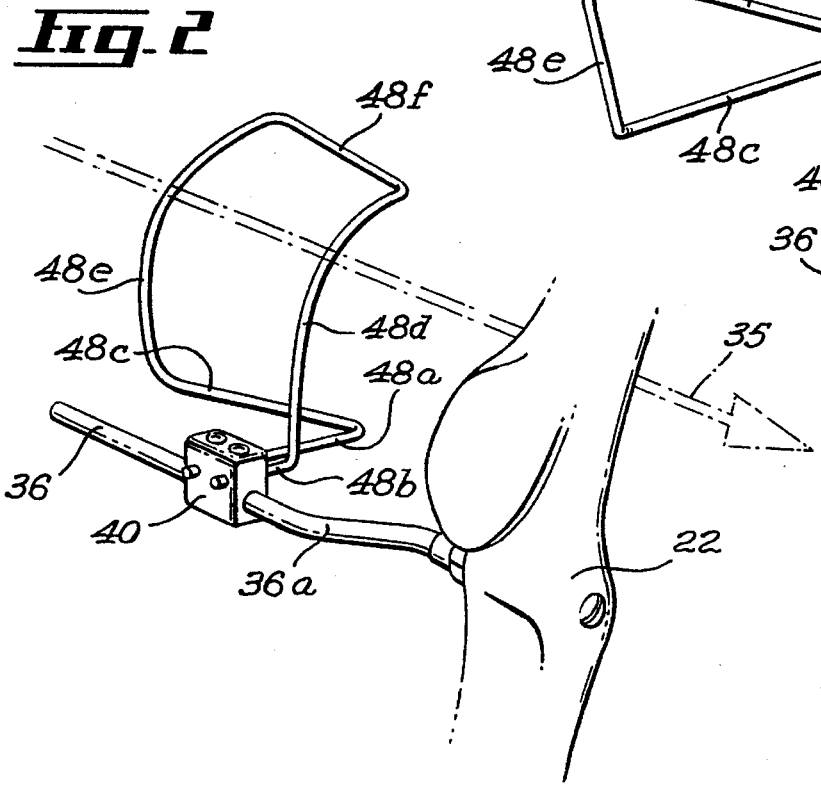
FIG. 2 is an isometric view of the armguard device and associated stabilizer rod together with a broken portion of the bow frame, and further showing in phantom lines part of an arrow in the background.
Figure 3:
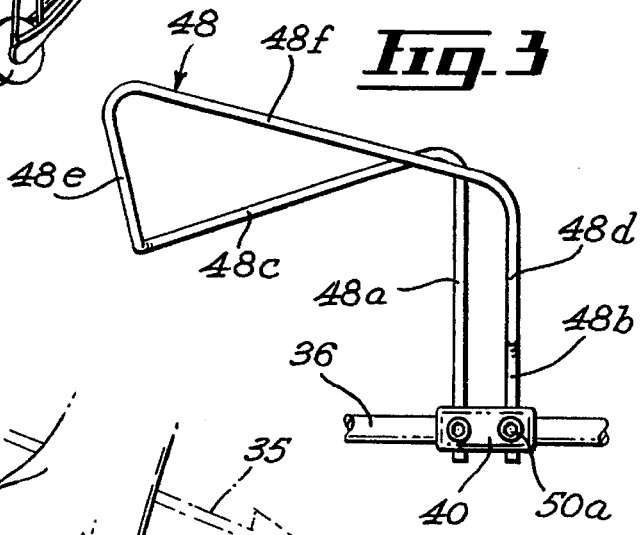
FIG. 3 is a top plan view of the armguard device and a broken portion of the stabilizer rod.

The compound bow 20 of FIG. 1 defines an arcuate rigid (though elastically deformable under the strain of the bowstring) frame 22 carrying two idle pulleys 24, 26, at its opposite ends. A multistrand cable 28, including inner strands 30, 32, and outer strand 34, is trained through the pulleys 24, 26, in the known fashion. The run of the outer cable strand 34 constitutes the "bowstring", upon which the arrow A is nocked. To the intermediate section of the bow frame 22 transversely projects a stabilizer rod 36 which is elbowed on its free outer end portion. A cable guard 38 is mounted to the stabilizer rod to capture and retain the inner cable strands 30, 32, in an offset fashion relative to the plane lying between the bow frame 22 and the bowstring 34, to prevent the inner cable strands from interfering with the operative movements of the bowstring. FIG. 1 further illustrates an arrow 35 nocked and ready to be fired (by releasing bowstring 34).

Figure 5:
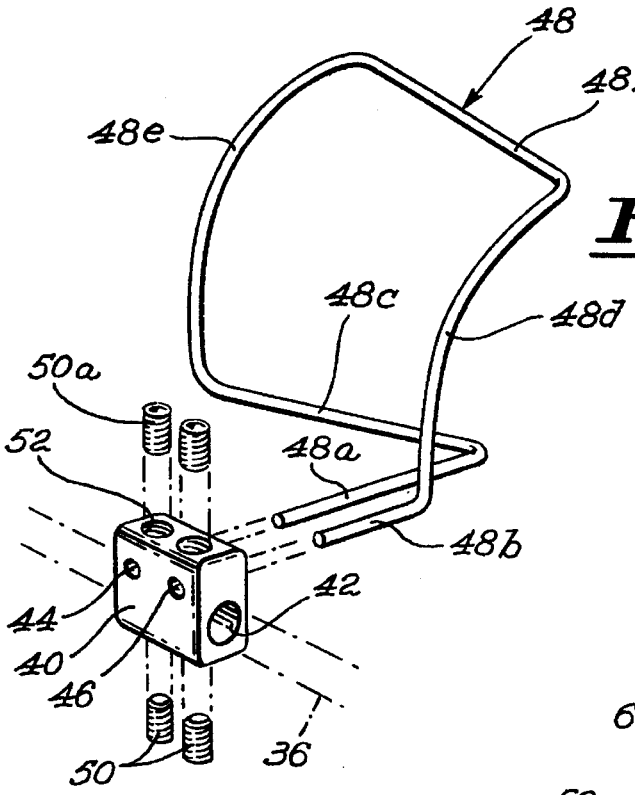
FIGS. 5 and 6 are exploded views of the first and of a second embodiments of armguards according to the invention, showing in phantom lines the outline of the stabilizer rod.

According to the invention, there is disclosed a block member or box-like casing, 40 (FIG. 5), being provided with a through-channel 42 for sliding through-engagement by the stabilizer rod 36. The casing 40 also includes a pair of smaller through-bores 44, 46, extending transversely of channel 42 and above same (relative to stabilizer rod 36). The through-bores 44, 46, are engaged by straight, opposite end portions 48*a*, 48*b*, of a single, irregularly looped shield rod 48.

Shield rod 48 forms an open shield member, shaped to conformingly fit around the interior half section of an archer's forearm. The short straight end segment 48*b* of the shield rod 48 is on the side of the bow frame 22, while the longer straight end segment 48*a* is away from the bow frame 22. Rod segments 48*a*, 48*b*, are coplanar. Beyond the long straight end segment 48*a*, there is provided another straight segment 48*c*, extending within the same plane as segment 48*a* and making a large acute angle in a direction away from the short segment 48*b*. Accordingly, and as suggested in FIG. 1, the combination of planar segments 48*a*, 48*c*, form a large V-shape base for flatly supporting the bottom edge of an archer's forearm when holding in position the bow.

From each of the straight segments 48*b* and 48*c* project two upwardly outwardly extending arcuate rod segments 48*d*, 48*e*. By "outwardly" is meant that the arcuate segments are bent laterally away from to the stabilizer rod 36, so that the concave side of these two segments 48*d*, 48*e* be freely engageable around the half section of the archer's forearm when the archer's forearm rests flatly against the V-base 48*b*, 48*c*. Both arcuate segments 48*d*, 48*e*, are joined by an intermediate straight segment 48*f*. Segment 48*f* is downwardly—relative to the common plane defined by rod segments 48*a*, 48*b*, 48*c*—inclined and angled towards bow frame 22 from long aft segment 48*e* to short fore segment 48*d*, so as to shapingly follow the archer's forearm thinning occurring from the elbow portion to the wrist portion of the forearm.

Casing 40 is releasably anchored to stabilizer rod 36 by first anchoring means, preferably embodied by a number—e.g. one pair—of set screw type short threaded stems 50 (FIG. 5) which engage threaded bores (not shown) made into casing 40. Those bores extend transversely of through channel 42. The two end lips 48*a*, 48*b* of the shield rod 48 are also releasably anchored to the casing 40 by second anchoring means, preferably embodied by some friction fit engagement with complementarily sized bores 44, 46, or alternately, by other set screw type short stems 50*a* (e.g. one pair of stems) engaging threaded bores 52 in the casing 40 (as illustrated in FIGS. 1 to 6). This second releasable attachment permits the lateral offset of shield rod 48 relative to casing 40, which allows a more precise adjustment for archers with arms of various dimensions who will use the bow equipped with the armguard of the invention.

When bowstring 34 is released from an extended or drawn position (illustrated in FIG. 1) to propel arrow 25 towards a target, it follows a spaced tangential course relative to the forearm A of the archer. However, it is likely that the path of bowstring 34 would occasionnally intersect in a non-spaced tangential fashion the archer forearm A (as explained in the background of the invention). With bow 20 provided with shield rod 48, bow string 34 would, instead of shearing forearm A, collide with arcuate aft segment 48*e* somewhere along it since it contours the interior half of forearm A at a particular position near the elbow. Bowstring 34 would then gradually space itself from forearm A by transversely—relative to its usual propelling path—sliding along aft segement 48*e* towards segment 48*c* until it reaches its usual propeling path, thus being harmless to the archer. The usual propelling path of bowstring 34 is defined as the course it follows when released from its drawn position to its steady position (unextended), this course being parallel to—and spaced from—archer forearm A.

It is highly desirable to provide the armguard of this embodiment with arcuate fore segment 48*d* and straight segment 48*f*, the latter linking to the former arcuate aft segment 48*e*, to improve the rigidity of the armguard. Indeed, without segments 48*d* and 48*f* as elements of the armguard, it is likely that the armguard would lack rigidity and that bowstring 34 would be deflected well off its usual propelling path, due to the elastical bending of aft segment 48*e* instead of a slidable engagement, when the collision occurs between it and bowstring 34. It is thus advantageous to provide fore segment 48*d* and straight segment 48*f* to improve the structural rigidity of the armguard.

Figure 4:
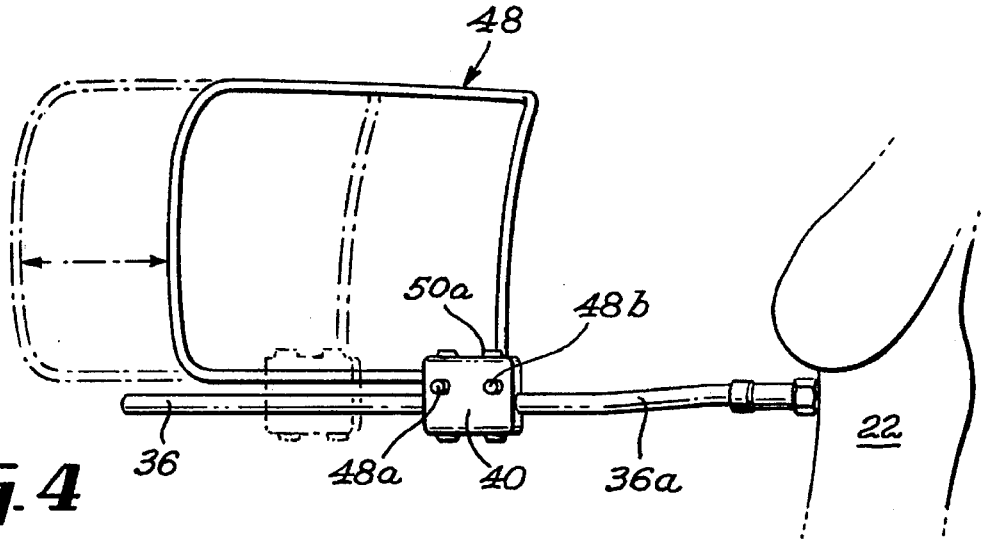
FIG. 4 is a side elevation of the elements of FIG. 2, and further suggesting the play of the armguard along the bow stabilizer.

FIG. 4 suggests how, by sliding casing 40 lengthwisely along the stabilizer rod 36 before screwingly tightening stems 50 on rod 36, the distance between the shield rod 48 and bow frame 22 can be adjusted, to fit various arm lengths corresponding to archers of various heights. It is noted that casing 40 should not be allowed to slide beyond the inner elbow 36*a* of the stabilizer rod 36, since this would in effect divert the interior edges of curved rod segments 48*d*, 48*e*, within the vertical plane through which the bowstring is drawn or released, thus rendering the bow substantially inoperative since it would hamper free motion of the bowstring therethrough.

Figure 6:
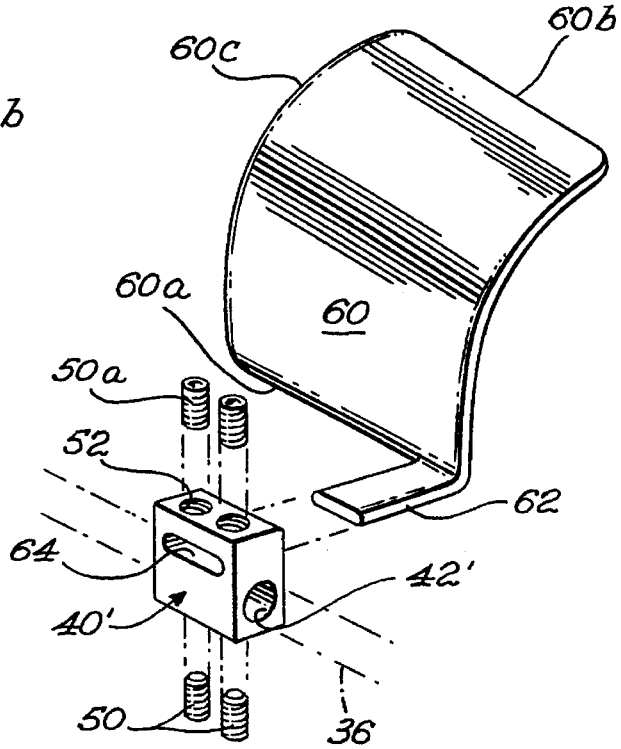

FIG. 6 illustrates an alternate embodiment of the invention, in which the forearm guard or shield, instead of being open and comprising a peripheral rod, now consists of an arcuate full panel 60. Panel 60 has the general shape of a planar projection extending between rods 48*d*, 48*e*, 48*f* (from the first embodiment of armguard) and a lower straigth edge 60*a*. Lower edge 60*a* is, in this embodiment, parallel to an upper edge 60*b* corresponding to straight segment 48*f* of the first embodiment. Connector rod segments 48*a*, 48*b*, are replaced in the new embodiment of FIG. 6 by a transverse lip 62, depending transversely from a corner edge section of the curved panel 60. Rectangular full lip 62 has a constant generally ovoidal cross-section and extends through a complementary ovoidal channel 64 made through casing 40' with channel 64 extending transversely to channel 42'. Once again, a number—e.g. one pair—of set screw type short threaded stems 50 releasably anchor transverse lip 62 by screwingly engaging complementary threaded bores 52 in casing 40'.

Also, since the aft edge 60*c*, corresponding to aft segment 48*e* of the first embodiment, has the same arcuate smooth shape as the latter, bowstring 34 would be gradually deflected to its armless usual propelling path if a collision were to occur between it and aft edge 60*c*, as explained for the first embodiment of armguard.

Again, as with the first embodiment of arm guard, sliding casing 40' lengthwisely along the stabilizer rod 36 permits the adjustment of the distance between guard panel 60 and bow frame 22.

The advantage of this second embodiment over the first is that the fullness of panel 60 allows a margin of error in the position adjustment of the armguard along cable guard 36. Indeed, if the armguard is positioned too near the elbow of the archer, it is hardly probable but possible that bowstring 34 will connect with panel 60 on its intermediate portion, where shield rod 48 would have offered no protection. Of course, a correctly positioned shield rod 48 obliviates this problem.

The disadvantage of this second embodiment is of course the greater weight of full panel 60 compared to the lighter weight of shield rod 48.

Although a right-hand side armguard has been illustrated, it is understood that a mirror-image armguard would be perfectly suitable for a left-handed archer, and would remain well within the scope of the present invention.

Also, although a compound bow has been illustrated, it is understood that other types of bows, including less sophisticated ones, could still benefit—although to a lesser scale—from the teachings of the present armguard mounting. The stabilizer rod would then have to be replaced by a support rod that would preferably be releasably anchored by anchoring means which do not alter the structural integrity of the rigid frame of the bow, e.g. the anchoring means could consist of a plurality of set screws provided with elastomeric cushions (e.g. rubber pads) at their extremity engaging the bow rigid frame outer surface. It is thus understood that when reference is made to the stabilizer rod, the present invention could be adapted to a sustaining rod of the above-described type.

In the second embodiment of the invention, it is understood that the full panel shoud preferably be of a dark, non-reflective colour, to prevent the prey from being accidentally alerted of the presence of the hunter due to light reflections.

The embodiments of the invention for which an exclusive property or privilege is claimed, are defined as follows:

1. An armguard device for use with an archer's compound bow, the compound bow of the type including an arcuate frame tensioning a bowstring and from which transversely projects an elongated, elbowed stabilizer shaft, said armguard device consisting of:

(a) a slider member, slidingly engageable with said stabilizer shaft for lengthwise displacement therealong;

(b) first anchoring means, for releasably anchoring said slider member along said stabilizer shaft;

(c) a rigid shield member, for engaging the archer's forearm and for shielding same against bowstring release whiplash; and (d) second anchoring means, for anchoring said shield member to said slider member, whereby a laterally offset positioning of the shield member is achieved relative to the stabilizer shaft, to slightly offset the shield member from the bowstring pathway to allow unhindered release thereof;

wherein the distance between said shield member and said bow frame is adjustable by displacing said slider member along said stabilizer shaft, to fit the arms of archers of different heights.

2. An armguard device as defined in claim 1, wherein said rigid shield member is arcuate and of such a shape as to conformingly fit around the internal half section of the archer's forearm, whereby said arcuate shield member defines a concave external side, for directly engaging the archer's forearm, and a convex internal side, for sliding engagement by the bowstring upon release thereof, whereby the archer's forearm remains spaced at all times from the releasing bowstring.

3. An armguard device as defined in claim 2, wherein said slider member consists of a casing having a main through-bore, for through engagement by said stabilizer rod.

4. An armguard device as defined in claim 3, wherein said arcuate shield member consists of an open structure made of a peripheral stem having a main intermediate section, elbowed conformingly to the forearm internal half section, and two opposite straight end portions; said slider member casing further including a pair of secondary through-bores, extending transversely of said main through-bore and releasably engaged by said stem two end portions and anchored therein by said second anchoring means, said second anchoring means being releasable, said stem two end portions being of such a length as to enable said laterally offset positioning of the shield member intermediate section.

5. An armguard device as defined in claim 4, wherein said shield member stem is cylindrical.

6. An armguard device as defined in claim 5, wherein said peripheral stem main intermediate section consists of four stem segments of which two non-consecutive stem segments are arcuately shaped and the two other segments are straight; said two arcuately shaped stem segments being both located on said internal side of said shield member, while said two straight stem segments are located on said external side of the shield member.

7. An armguard device as defined in claim 4, wherein said first and second anchoring means consist of set screw means.

8. An armguard device as defined in claim 7, wherein said first and second anchoring means consist of set screw means.

9. An armguard device as defined in claim 3, wherein said arcuate shield member consists of a full panel having a main arcuate section, which is elbowed conformingly to the forearm internal half section, and a straight lip, transversely projecting from an edge of said main arcuate section; said slider member casing further including an ovoidal through-bore, extending transversely of said main through-bore and releasably engaged and sized to be fitted by said panel lip and anchored therein by said second anchoring means, said panel lip being of such a length as to enable said laterally offset positioning of the shield member intermediate section.

10. An archer's compound bow including an arcuate frame tensioning a bowstring and from which transversely projects an elongated, elbowed stabilizer guard rod and an armguard device consisting of:

(a) a slider member, slidingly engageable with said stabilizer rod for lengthwise displacement therealong;

(b) first anchoring means, for releasably anchoring said slider member along said stabilizer rod;

(b) a rigid shield member, for engaging the archer's forearm and for shielding same against bowstring release whiplash; and (c) anchoring means, for releasably anchoring said shield member to said slider member, whereby a laterally offset positioning of the shield member is achieved relative to the stabilizer rod, to slightly offset the shield member from the bowstring pathway to allow unhindered release thereof; the distance between said shield member and said bow frame being adjustable by displacing said slider member along said stabilizer rod, to fit the arms of archers of different heights;

wherein said rigid shield member is arcuate and of such a shape as to conformingly fit around the internal half section of the archer's forearm, whereby said arcuate shield member defines a concave external side, for directly engaging the archer's forearm, and a convex internal side, for sliding engagement by the bowstring upon release thereof, whereby the archer's forearm remains spaced at all times from the releasing bowstring.

* * * * *